US011230684B2

(12) United States Patent
Boons et al.

(10) Patent No.: US 11,230,684 B2
(45) Date of Patent: Jan. 25, 2022

(54) MARINE DIESEL LUBRICANT OIL COMPOSITIONS

(71) Applicant: Chevron Oronite Technology B.V., San Ramon, CA (US)

(72) Inventors: Cornelis Hendrikus Maria Boons, Prinsenbeek (NL); Theodorus Constance Cleophas, Rotterdam (NL)

(73) Assignee: CHEVRON ORONITE TECHNOLOGY B.V., Rotterdam (NL)

( * ) Notice: Subject to any disclaimer, the term of this patent is extended or adjusted under 35 U.S.C. 154(b) by 0 days.

(21) Appl. No.: 16/333,650

(22) PCT Filed: Oct. 17, 2017

(86) PCT No.: PCT/EP2017/076518
§ 371 (c)(1),
(2) Date: Mar. 15, 2019

(87) PCT Pub. No.: WO2018/073268
PCT Pub. Date: Apr. 26, 2018

(65) Prior Publication Data

US 2019/0256794 A1 Aug. 22, 2019

Related U.S. Application Data

(60) Provisional application No. 62/409,716, filed on Oct. 18, 2016.

(51) Int. Cl.

| | |
|---|---|
| ***C10M 169/04*** | (2006.01) |
| ***C10M 129/10*** | (2006.01) |
| ***C10M 129/30*** | (2006.01) |
| ***C10N 10/02*** | (2006.01) |
| ***C10N 10/04*** | (2006.01) |
| ***C10N 30/04*** | (2006.01) |
| ***C10N 30/08*** | (2006.01) |
| ***C10N 30/10*** | (2006.01) |
| ***C10N 30/00*** | (2006.01) |
| ***C10N 40/25*** | (2006.01) |

(52) U.S. Cl.

CPC ..... *C10M 169/04* (2013.01); *C10M 129/10* (2013.01); *C10M 129/30* (2013.01); *C10M 2207/023* (2013.01); *C10M 2207/027* (2013.01); *C10M 2207/028* (2013.01); *C10M 2207/144* (2013.01); *C10M 2207/26* (2013.01); *C10M 2207/262* (2013.01); *C10M 2219/046* (2013.01); *C10M 2219/087* (2013.01); *C10M 2219/088* (2013.01); *C10M 2219/089* (2013.01); *C10N 2010/02* (2013.01); *C10N 2010/04* (2013.01); *C10N 2030/04* (2013.01); *C10N 2030/08* (2013.01); *C10N 2030/10* (2013.01); *C10N 2030/40* (2020.05); *C10N 2030/52* (2020.05); *C10N 2040/252* (2020.05)

(58) Field of Classification Search

CPC ..... C10M 129/10; C10M 129/30; C10M 169/04; C10M 2207/023; C10M 2207/027; C10M 2207/028; C10M 2207/144; C10M 2207/26; C10M 2207/262; C10M 2219/046; C10M 2219/087; C10M 2219/088; C10M 2219/089; C10N 2210/01; C10N 2210/02; C10N 2230/04; C10N 2230/08; C10N 2230/10; C10N 2230/40; C10N 2230/52; C10N 2240/102

See application file for complete search history.

(56) References Cited

U.S. PATENT DOCUMENTS

| | | | | |
|---|---|---|---|---|
| 2,680,096 | A | 6/1954 | Walker et al. | |
| 2,992,708 | A | 7/1961 | Albert | |
| 3,018,250 | A | 1/1962 | Anderson et al. | |
| 3,018,291 | A | 1/1962 | Anderson et al. | |
| 3,024,237 | A | 3/1962 | Drummond et al. | |
| 3,100,673 | A | 8/1963 | Hans et al. | |
| 3,172,892 | A | 3/1965 | Le Suer et al. | |
| 3,178,368 | A | 4/1965 | Hanneman | |
| 3,215,707 | A | 11/1965 | Rense | |
| 3,219,666 | A | 11/1965 | George et al. | |
| 3,231,587 | A | 1/1966 | Rense | |
| 3,515,669 | A | 6/1970 | Le Suer | |
| 3,579,450 | A | 5/1971 | Lesuer | |
| 4,388,471 | A | 6/1983 | Wollenberg | |
| 4,948,522 | A * | 8/1990 | Dunn | C10M 167/00 508/192 |
| 6,153,565 | A | 11/2000 | Skinner et al. | |

(Continued)

FOREIGN PATENT DOCUMENTS

| | | |
|---|---|---|
| EP | 1314773 | 5/2003 |
| JP | H10183153 A | 7/1998 |

(Continued)

OTHER PUBLICATIONS

Office Action, dated Nov. 10, 2020, issued in Japanese Application No. 2019-517961, filed on Oct. 17, 2017, 6 pages.
Written Opinion, dated Apr. 13, 2021, issued in Singapore Application No. 11201901690U, filed on Oct. 17, 2017, 7 pages.
Office Action, dated Jun. 16, 2021, issued in Chinese Application No. 201780064001.4, filed on Oct. 17, 2017, 22 pages.
Europe Office action dated Sep. 9, 2021 issued in Application No. 17790731.8, filed Feb. 27, 2019, 6 pages.

*Primary Examiner* — James C Goloboy

(57) ABSTRACT

A lubricating oil composition can include a major amount of an oil of lubricating viscosity and a minor amount of an alkaline earth metal phenol-based detergent. The lubricating oil composition can further have a BN of greater than 140 mg KOH/g, and further wherein the marine diesel cylinder lubricating oil composition is substantially free of unsulfurized tetrapropenyl phenol and its unsulfurized metal salt.

16 Claims, No Drawings

(56) References Cited

U.S. PATENT DOCUMENTS

| | | | | |
|---|---|---|---|---|
| 6,339,051 | B1 * | 1/2002 | Carey | C10M 169/048 508/391 |
| 6,372,696 | B1 | 4/2002 | Tipton | |
| 6,429,178 | B1 | 8/2002 | Skinner et al. | |
| 6,429,179 | B1 | 8/2002 | Skinner et al. | |
| 9,328,309 | B2 | 5/2016 | Mahieux et al. | |
| 2011/0195878 | A1 * | 8/2011 | Tellier | C10M 107/10 508/110 |
| 2015/0126422 | A1 * | 5/2015 | Boons | C10M 169/042 508/391 |
| 2016/0237370 | A1 * | 8/2016 | Houten | C10M 141/08 |

FOREIGN PATENT DOCUMENTS

| | | | |
|---|---|---|---|
| WO | 2017013257 | W | 1/2017 |
| WO | 2018069460 | W | 4/2018 |

* cited by examiner

MARINE DIESEL LUBRICANT OIL COMPOSITIONS

TECHNICAL FIELD

The present invention generally relates to a marine diesel cylinder lubricating oil composition, having a total base number of greater than 140 mg KOH/g, for lubrication of a marine diesel two-stroke crosshead engine.

BACKGROUND OF THE INVENTION

Marine diesel internal combustion engines may generally be classified as low-speed, medium-speed, or high-speed engines, with the low-speed variety being used for the largest, deep draft marine vessels and certain other industrial applications such as power generation applications.

Low-speed diesel engines are unique in size and method of operation. These engines are quite large and typically operate in the range of about 60 to about 200 revolutions per minute. A low-speed diesel engine operates on the two-stroke cycle and is typically a direct-coupled and direct-reversing engine of "crosshead" construction, with a diaphragm and one or more stuffing boxes separating the power cylinders from the crankcase to prevent combustion products from entering the crankcase and mixing with the crankcase oil. The complete separation of the crankcase from the combustion zone has led persons skilled in the art to lubricate the combustion chamber and the crankcase with different lubricating oils, a cylinder lubricant and system oil respectively, due to the unique requirements of each type of lubricant.

In two-stroke crosshead engines, the cylinders are lubricated on a total loss basis with the cylinder oil being injected separately on each cylinder, by means of lubricators positioned around the cylinder liner. Cylinder lubricant is not recirculated and is combusted along with the fuel. The cylinder lubricant needs to provide a strong film between the cylinder liner and the piston rings for sufficient lubrication of the cylinder walls to prevent scuffing, be thermally stable in order that the lubricant does not form deposits on the hot surfaces of the piston and the piston rings and be able to neutralize sulfur-based acidic products of combustion. This neutralization is accomplished by the inclusion in the marine diesel cylinder lubricant of basic species such as metallic detergents.

Marine two-stroke diesel cylinder lubricants must meet performance demands in order to comply with the severe operating conditions required for more modern larger bore, two-stroke cross-head diesel marine engines which can run at high outputs and severe loads and higher temperatures of the cylinder liner. Presently, the design of larger bore engines, as well as changes in their typical operation (i.e. lower outputs, lower loads and lower temperatures of the cylinder liner) have contributed to the frequent occurrence of severe cold corrosion. Cold corrosion is contributed by the combination of a corrosive environment, due to presence of sulfuric acid, and a simultaneous mechanical wear mechanism (i.e. adhesive or abrasive wear). The sulfur oxides that result from combustion of the fuel will, with the water formed during combustion and the water from the scavenge air, form sulfuric acid. When the liner temperature drops below the dew point of sulfuric acid and water, a corrosive mixture is condensed on the liner. Cylinder lubricant basicity, cylinder lubricant feed rate of the oil to the cylinder liner, engine make and type, engine load, inlet air humidity and fuel sulfur content are among the factors that can influence the amount of cold corrosion. High alkaline lubricants are needed to neutralize the sulfuric acids and avoid cold corrosion of piston rings and cylinder liner surfaces.

In modern two-stroke engines, marine diesel cylinder lubricants can be subjected to much higher temperatures compared to previous engine designs. As a result, heavy deposit formation can cause increased adhesive wear and therefore, deposit control performance of cylinder oil detergents have become of key importance. A cylinder oil that prevents heavy deposit formulation can lead to improved wear performance in addition to longer time between engine overhaul which in turn reduces the cost of engine operation for today's hotter engines.

High alkalinity lubricants having up to 100 BN are currently being marketed to help overcome severe cold corrosion and deposit formation but typically contain high to medium concentrations of conventional sulfurized, overbased phenate detergent. In the past it has been taught that higher to moderate phenate content of a marine diesel cylinder lubricant helps deposit performance of high BN oils. Also, due to their typically high viscosities, phenate components have helped to reduce the amount of brightstock needed in a formulation to achieve the viscosity requirements for marine diesel cylinder lubricants.

Sulfurized, overbased phenate detergents are known compounds which are widely used in marine applications for their detergency properties and thermal stability. However, low molecular weight alkylphenol compounds such as tetrapropenyl phenol are most commonly used as raw materials in the manufacture of these sulfurized, overbased phenates. The process to manufacture overbased phenates generally results in the presence of the unreacted, unsulfurized tetrapropenyl phenol and its unsulfurized metal salt (TPP) in the final reaction product and ultimately in the finished lubricating oil composition. Recent reproductive toxicity studies have shown that high concentrations of TPP, in particular, may be endocrine disruptive materials which can cause adverse effects in male and female reproductive organs.

There is need in the industry for alternative formulating solutions for the formulation of higher alkalinity marine diesel cylinder lubricating oil technology, having BN of greater than 140 mg KOH/g, to overcome challenges for modern two-stroke engines which does not rely on traditional marine cylinder lubricant formulating technology having medium to high concentrations of conventional sulfurized phenate detergent derived from tetrapropenyl phenol, which provides sufficient oxidative stability, BN retention, detergency and wear performance while avoiding potential health risks to end users and regulatory issues. In addition, a higher BN oil will typically have more thickening efficiency than a lower BN oil which can allow for an alternative solution over brightstock or other thickeners to impart the desired viscometrics for a marine diesel cylinder lubricant.

SUMMARY OF THE INVENTION

In accordance with one embodiment of the present invention, there is provided a lubricating oil composition comprising:

(a) a major amount of an oil of lubricating viscosity; and (b) a minor amount of an alkaline earth metal phenol-based detergent;

wherein the lubricating oil composition has a BN of greater than 140 mg KOH/g, and further wherein the marine diesel cylinder lubricating oil composition is substantially free of unsulfurized tetrapropenyl phenol and its unsulfurized metal salt.

In accordance with one embodiment of the present invention, there is provided a lubricating oil composition comprising:

(a) a major amount of an oil of lubricating viscosity; and (b) a minor amount of an overbased alkaline earth metal alkylphenate detergent;

wherein the lubricating oil composition has a BN of greater than 140 mg KOH/g, and further wherein the marine diesel cylinder lubricating oil composition is substantially free of unsulfurized tetrapropenyl phenol and its unsulfurized metal salt.

In accordance with one embodiment of the present invention, there is provided a lubricating oil composition comprising:

(a) a major amount of an oil of lubricating viscosity; and (b) a minor amount of an overbased sulfurized, alkaline earth metal alkylphenate detergent;

wherein the lubricating oil composition has a BN of greater than 140 mg KOH/g, and further wherein the marine diesel cylinder lubricating oil composition is substantially free of unsulfurized tetrapropenyl phenol and its unsulfurized metal salt.

DETAILED DESCRIPTION OF THE PREFERRED EMBODIMENTS

A "marine residual fuel" refers to a material combustible in large marine engines which has a carbon residue, as defined in International Organization for Standardization (ISO) 10370) of at least 2.5 wt. % (e.g., at least 5 wt. %, or at least 8 wt. %) (relative to the total weight of the fuel), a viscosity at 50° C. of greater than 14.0 cSt, such as the marine residual fuels defined in the International Organization for Standardization specification ISO 8217:2005, "Petroleum products—Fuels (class F)—Specifications of marine fuels," the contents of which are incorporated herein in their entirety.

A "residual fuel" refers to a fuel meeting the specification of a residual marine fuel as set forth in the ISO 8217:2010 international standard. A "low sulfur marine fuel" refers to a fuel meeting the specification of a residual marine fuel as set forth in the ISO 8217:2010 specification that, in addition, has about 1.5 wt. % or less, or even about 0.5% wt. % or less, of sulfur, relative to the total weight of the fuel.

A "distillate fuel" refers to a fuel meeting the specification of a distillate marine fuel as set forth in the ISO 8217:2010 international standard. A "low sulfur distillate fuel" refers to a fuel meeting the specification of a distillate marine fuel set forth in the ISO 8217:2010 international standard that, in addition, has about 0.1 wt. % or less or even about 0.005 wt. % or less, of sulfur, relative to the total weight of the fuel.

A "low sulfur fuel" refers having about 1.5 wt. % or less, or even about 1.0 wt. % or less, or even 0.5% wt. % or less, or even 0.1 wt. % or less of sulfur, relative to the total weight of the fuel.

The term "on an actives basis" refers to additive material that is not diluent oil or solvent.

In one embodiment, the marine diesel cylinder lubricating oil composition of the present invention is substantially free of an unsulfurized tetrapropenyl phenol compound and its unsulfurized metal salt, (i.e., TPP). The term "substantially free" as used herein means relatively low levels, if any, of the unsulfurized tetrapropenyl phenol and its unsulfurized metal salt, e.g., less than about 1.65 wt. % in the marine diesel cylinder lubricating oil composition. In another embodiment, the term "substantially free" is less than about 1.6 wt. % in the marine diesel cylinder lubricating oil composition. In another embodiment, the term "substantially free" is less than about 1.5 wt. % in the marine diesel cylinder lubricating oil composition. In another embodiment, the term "substantially free" is less than about 1.4 wt. % in the marine diesel cylinder lubricating oil composition. In another embodiment, the term "substantially free" is less than about 1.3 wt. % in the marine diesel cylinder lubricating oil composition. In another embodiment, the term "substantially free" is less than about 1.2 wt. % in the marine diesel cylinder lubricating oil composition. In another embodiment, the term "substantially free" is less than about 1.0 wt. % in the marine diesel cylinder lubricating oil composition. In another embodiment, the term "substantially free" is less than about 0.5 wt. %. In another embodiment, the term "substantially free" is less than about 0.3 wt. %. In another embodiment, the term "substantially free" is less than about 0.25 wt. %. In another embodiment, the term "substantially free" is less than about 0.1 wt. %. In another embodiment, the term "substantially free" is from about 0.0001 to about 0.3 wt. %. In another embodiment, the term "substantially free" is zero percent.

The term "Total Base Number" or "TBN" or "BN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mg·KOH/g (the equivalent number of milligrams of KOH needed to neutralize 1 gram of a product). Therefore, a high TBN reflects strongly overbased products and, as a result, a higher base reserve for neutralizing acids. The marine diesel cylinder lubricating oil composition of the present invention can have any TBN that is suitable for use as a marine diesel cylinder lubricant. In some embodiments, the TBN of the marine cylinder lubricating oil composition of the present invention is greater than 140 mg KOH/g. In other embodiments, the TBN of the marine lubricating oil composition is greater than 145 mg KOH/g. In other embodiments, the TBN of the marine lubricating oil composition of the present disclosure can range from about 145 to about 210, or from about 150 to about 210, or from about 155 to about 210, or from about 160 to about 210, or from about 170 to about 210, or from about 180 to about 210 mg KOH/g, or from about 145 to 200, or from about 150 to about 200, or from about 160 to 200, or from about 180 to 200 mg KOH/g.

The lubricating oil composition may be SAE 30 monograde lubricating oil composition, or an SAE 40 monograde lubricating oil composition, or an SAE 50 monograde lubricating oil composition, or an SAE 60 monograde lubricating oil composition. The monograde of the lubricating oil composition is defined according to the SAE J300 standard Rev. January 2015.

The marine diesel cylinder lubricating oil compositions of this invention can have a kinematic viscosity ranging from about 9.3 to about 26.1 cSt at 100° C., or about 9.3 to about 21.9 cSt at 100° C., or about 9.3 to about 16.3 cSt at 100° C., or about 12.5 to about 26.1 cSt at 100° C., or about 12.5 to about 21.9 cSt at 100° C., or about 12.5 to about 16.3 cSt at 100° C., or about 16.3 to about 21.9 cSt at 100° C., or about 16.3 to about 26.1 cSt at 100° C. The kinematic viscosity of the marine diesel lubricating oil compositions is measured by ASTM D445.

The marine diesel cylinder lubricating oil compositions of the present invention can be prepared by any method known to a person of ordinary skill in the art for making marine diesel cylinder lubricating oil compositions. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer, a homogenizer, a mil, or any other mixing or dispersing equipment known in the art.

The marine diesel lubricant composition of the present invention includes a major amount of an oil of lubricating viscosity. By "a major amount" it is meant that the marine diesel lubricant composition suitably includes at least about 40 wt. %, or at least about 45 wt. %, or at least about 50 wt. %, or at least about 55 wt. %, or at least about 60 wt. %, and particularly at least about 70 wt. %, of an oil of lubricating viscosity as described below, based on the total weight of the marine diesel lubricant oil composition.

The oil of lubricating viscosity may be any oil suitable for the lubrication of marine diesel engines. The oil of lubricating viscosity may be a base oil derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude.

Suitable natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Suitable synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof; alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art. Additional synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

The oil of lubricating viscosity may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the wax produced by the Fischer-Tropsch process.

In one embodiment, the oil of lubricating viscosity is a Group I basestock. In general, a Group I basestock for use herein can be any petroleum derived base oil of lubricating viscosity as defined in API Publication 1509, 16th Edition, Addendum I, October, 2009. API guidelines define a base stock as a lubricant component that may be manufactured using a variety of different processes. Group I base oils generally refer to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

Group I base oils can comprise light overhead cuts and heavier side cuts from a vacuum distillation column and can also include, for example, Light Neutral, Medium Neutral, and Heavy Neutral base stocks. The petroleum derived base oil also may include residual stocks or bottoms fractions, such as, for example, brightstock. Brightstock is a high viscosity base oil which has been conventionally produced from residual stocks or bottoms and has been highly refined and dewaxed. Brightstock can have a kinematic viscosity greater than about 180 cSt at 40° C., or even greater than about 250 cSt at 40° C., or even ranging from about 500 to about 1100 cSt at 40° C.

In one embodiment, the one or more basestocks can be a blend or mixture of two or more, three or more, or even four or more Group I basestocks having different molecular weights and viscosities, wherein the blend is processed in any suitable manner to create a base oil having suitable properties (such as the viscosity and TBN values, discussed above) for use in a marine diesel engine. In one embodiment, the one or more basestocks comprises ExxonMobil CORE®100, ExxonMobil CORE®150, ExxonMobil CORE®600, ExxonMobil CORE®2500, or a combination or mixture thereof.

In another embodiment, the oil of lubricating viscosity is a Group II basestock as defined in API Publication 1509, 16th Edition, Addendum I, October, 2009. A Group II basestock generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

In one embodiment, the one or more basestocks can be a blend or mixture of two or more, three or more, or even four or more Group I and/or Group II basestocks having different molecular weights and viscosities, wherein the blend is processed in any suitable manner to create a base oil having suitable properties (such as the viscosity and TBN values, discussed above) for use in a marine diesel engine.

In another embodiment, the oil of lubricating viscosity is a Group III basestock as defined in API Publication 1509, 16th Edition, Addendum I, October, 2009. A Group III basestock generally has a total sulfur content less than or equal to 0.03 wt. % (as determined by ASTM D 2270), a saturates content of greater than or equal to 90 wt. % (as determined by ASTM D 2007), and a viscosity index (VI) of greater than or equal to 120 (as determined by ASTM D 4294, ASTM D 4297 or ASTM D 3120). In one embodiment, the basestock is a Group III basestock, or a blend of two or more different Group III basestocks.

In general, Group III basestocks derived from petroleum oils are severely hydrotreated mineral oils. Hydrotreating involves reacting hydrogen with the basestock to be treated to remove heteroatoms from the hydrocarbon, reduce olefins and aromatics to alkanes and cycloparaffins respectively, and in very severe hydrotreating, open up naphthenic ring structures to non-cyclic normal and iso-alkanes ("paraffins"). In one embodiment, a Group III basestock has a paraffinic carbon content (% $C_p$) of at least about 70%, as determined by test method ASTM D 3238-95 (2005), "Standard Test Method for Calculation of Carbon Distribution and Structural Group Analysis of Petroleum Oils by the n-d-M Method". In another embodiment, a Group III basestock has a paraffinic carbon content (% $C_p$) of at least about 72%. In another embodiment, a Group III basestock has a paraffinic carbon content (% $C_p$) of at least about 75%. In another embodiment, a Group III basestock has a paraffinic carbon content (% $C_p$) of at least about 78%. In another embodiment, a Group III basestock has a paraffinic carbon content (% $C_p$) of at least about 80%. In another embodiment, a Group III basestock has a paraffinic carbon content (% $C_p$) of at least about 85%.

In another embodiment, a Group III basestock has a naphthenic carbon content (% $C_n$) of no more than about 25%, as determined by ASTM D 3238-95 (2005). In another embodiment, a Group III basestock has a naphthenic carbon content (% $C_n$) of no more than about 20%. In another embodiment, a Group III basestock has a naphthenic carbon content (% $C_n$) of no more than about 15%. In another embodiment, a Group III basestock has a naphthenic carbon content (% $C_n$) of no more than about 10%.

In one embodiment, a Group III basestock for use herein is a Fischer-Tropsch derived base oil. The term "Fischer-Tropsch derived" means that the product, fraction, or feed originates from or is produced at some stage by a Fischer-Tropsch process. For example, a Fischer Tropsch base oil can be produced from a process in which the feed is a waxy feed recovered from a Fischer-Tropsch synthesis, see, e.g., U.S. Patent Application Publication Nos. 2004/0159582; 2005/0077208; 2005/0133407; 2005/0133409; 2005/0139513; 2005/0139514; 2005/0241990 each of which are incorporated herein by reference. In general, the process involves a complete or partial hydroisomerization dewaxing step, employing a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions.

In another embodiment, the oil of lubricating viscosity is a Group IV basestock as defined in API Publication 1509, 16th Edition, Addendum I, October, 2009. A Group IV basestock, or polyalphaolefin (PAO) are typically made by the oligomerization of low molecular weight alpha-olefins, e.g., alpha-olefins containing at least 6 carbon atoms. In one embodiment, the alpha-olefins are alpha-olefins containing 10 carbon atoms. PAOs are mixtures of dimers, trimers, tetramers, etc., with the exact mixture depending upon the viscosity of the final basestock desired. PAOs are typically hydrogenated after oligomerization to remove any remaining unsaturation.

As stated above, lubricants for use in marine diesel engines typically have a kinematic viscosity in the range of 6.9 to 26.1 cSt at 100° C. In order to formulate such a lubricant, a brightstock may be combined with a lower viscosity oil. However, supplies of brightstock are dwindling and therefore brightstock cannot be relied upon to increase the viscosity of marine lubricants to the desired ranges that manufacturers recommend. One solution to this problem is to use thickeners such as polyisobutylene (PIB) or viscosity index improvers such as olefin copolymers to thicken marine lubricants. PIB is a commercially available material from several manufacturers. The PIB is typically a viscous oil-miscible liquid, having a weight average molecular weight in the range of about 1,000 to about 8,000, or from about 1,500 to about 6,000, and a viscosity in the range of about 2,000 to about 5,000 cSt (100° C.), or about 2,000 to about 6,000 cSt (100° C.). The amount of PIB added to marine lubricants will normally be from about 1 to about 20 wt. % of the finished oil, or from about 2 to about 15 wt. % of the finished oil, or from about 4 to about 12 wt. % of the finished oil.

The marine diesel cylinder lubricating oil composition of the present invention can contain one or more detergents. Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts.

Detergents that may be used include oil-soluble neutral and overbased sulfonates, phenates, sulfurized phenates, salixarates, saligenins, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

Commercial products are generally referred to as neutral or overbased. Overbased metal detergents are generally produced by carbonating a mixture of hydrocarbons, detergent acid, for example: sulfonic acid, carboxylate etc., metal oxide or hydroxides (for example calcium oxide or calcium hydroxide) and promoters such as xylene, methanol and water. For example, for preparing an overbased detergent, in carbonation, the calcium oxide or hydroxide reacts with the gaseous carbon dioxide to form calcium carbonate. The detergent acid is neutralized with an excess of CaO or $Ca(OH)_2$, to form the detergent. Alkaline earth metal hydrocarbon sulfonate can also be reacted with a boron compound selected from the group consisting of boric acids, boron oxides, and aqueous alkyl esters of boric acids to form overbased detergent.

Alkaline earth metal phenol-based detergents that may be used include oil-soluble neutral and overbased phenates, sulfurized phenates, salixarates, saligenins, salicylates, and naphthenates. The most commonly used metals are calcium and magnesium, which may both be present in detergents used in a lubricant, and mixtures of calcium and/or magnesium with sodium. It is desirable to use calcium hydroxide as the calcium base in the manufacture of detergents because of its handling convenience versus, for example, calcium oxide, and also because it affords excellent results. Other calcium bases can also be used, for example, calcium alkoxides.

In one embodiment, the alkaline earth metal phenol-based detergents may be chosen from phenates, sulfurized phenates, and salicylates. In one embodiment, the alkaline earth metal phenol-based detergent may also include "hybrid" detergents formed with mixed surfactant systems including phenate and/or sulfonate components, e.g., phenate/salicylates, sulfonate/phenates, sulfonate/salicylates, sulfonate/phenate/salicylates, as described for example in U.S. Pat. Nos. 6,429,178; 6,429,179; 6,153,565. In one embodiment, the alkaline earth metal phenol-based detergent may also include methylene-bridged polyphenol compositions prepared from the reaction of phenol with formaldehyde, or a reversible polymer thereof, optionally sulfurizing the methylene-bridged intermediate and subsequently reacting the intermediate with an excess of a metal base to produce a methylene bridged polyphenol phenate composition. In one embodiment the methylene bridged polyphenol phenate composition may be further reacted with an epoxide. In one embodiment the methylene bridged polyphenol phenate composition is not sulfurized. In one embodiment the alkaline earth metal phenol-based detergent may also include oil-soluble Mannich condensation products which are formed from the reaction of polyisobutyl-substituted phenols with formaldehyde and an amine or a polyamine or an amino acid.

Overbased alkaline earth metal salts of phenols and sulfurized phenols, which are overbased alkaline earth metal alkylphenate detergents, are prepared by reaction with an appropriate metal compound such as an oxide or hydroxide and neutral or overbased products may be obtained by methods well known in the art. Alkaline earth metal alkylphenate detergents that may be used include oil-soluble neutral and overbased phenates, sulfurized phenates, salixarates, saligenins, salicylates, mannichs, methylene bridged phenates, hybrid detergents and naphthenates. Sulfurized alkaline earth metal alkylphenate detergents are derived from sulfurized phenols which may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Overbased sulfurized, alkaline earth metal alkylphenate detergent compositions can be obtained by alkylating a hydroxyaromatic compound with an alkylating agent such as one or more olefins comprising $C_9$ to $C_{18}$ oligomers of monomers selected from propylene, butylene or mixtures thereof, to provide an alkyl-substituted hydroxyaromatic compound; and sulfurizing, neutralizing and overbasing the alkyl-substituted hydroxyaromatic compound in any order to provide an overbased salt of a sulfurized alkyl-substituted hydroxyaromatic composition. Additional details regarding the general preparation of sulfurized phenates can be found in, for example, U.S. Pat. Nos. 2,680,096; 3,178,368 and 3,801,507, the contents of which are incorporated herein by reference.

Suitable alkyl-substituted hydroxyaromatic compounds which can be used in the manufacture of alkaline earth metal phenol-based or alkylphenate based detergents are alkylphenols wherein the alkyl substituents contain a sufficient number of carbon atoms to render the resulting overbased sulfurized calcium alkylphenate composition oil-soluble. Oil solubility may be provided by a single long chain alkyl substitute or by a combination of alkyl substituents. Typically, the alkylphenol used in the present process will be a mixture of different alkylphenols, e.g., $C_{20}$ to $C_{24}$ alkylphenol. The alkylphenol can have straight-chain, non-isomerized, alkyl substituent of from about 15 to about 35 carbon atoms and from about 75 to about 0 mole percent in which the alkyl group is polypropenyl of from 9 to 18 carbon atoms. In one embodiment, about 35 to about 100 mole percent of the alkylphenol, the alkyl group will be a straight-chain alkyl of about 15 to about 35 carbon atoms and about from about 65 to 0 mole percent of the alkylphenol, the alkyl group will be polypropenyl of from about 9 to about 18 carbon atoms. In one embodiment, the alkyl substituent is entirely polypropenyl of from about 9 to about 18 carbon atoms. In one embodiment, the alkyl group is polypropenyl phenol such as tetrapropenyl phenol. In one embodiment, the alkyl substituent of the alkyl phenol is at least one normal alpha olefin having from about 10 to about 40 carbon atoms. In one embodiment, the normal alpha-olefins or mixtures of normal alpha-olefins have from about 16 to about 30 carbon atoms. In one embodiment, the normal alpha-olefins or mixtures of normal alpha-olefins have from about 18 to about 30 carbon atoms. In one embodiment, the normal alpha-olefins or mixtures of normal alpha-olefins have from about 20 to about 28 carbon atoms. In one embodiment, the normal alpha-olefins have from about 18 to about 24 carbon atoms.

In one embodiment, the alkyl substituent of the alkylphenol compound is a residue of at least one isomerized olefin having from about 15 to about 99 wt. % branching obtained by isomerizing at least one normal alpha olefin. The normal alpha-olefins that are isomerized prior to the alkylation of the hydroxyaromatic compounds are normal alpha-olefins or mixtures of normal alpha-olefins having from about 10 to about 40 carbon atoms per molecule. In one embodiment, the normal alpha-olefins or mixtures of normal alpha-olefins have from about 14 to about 30 carbon atoms. In one embodiment, the normal alpha-olefins or mixtures of normal alpha-olefins have from about 16 to about 30 carbon atoms. In one embodiment, the normal alpha-olefins or mixtures of normal alpha-olefins have from about 18 to about 30 carbon atoms. In one embodiment, the normal alpha-olefins or mixtures of normal alpha-olefins have from about 20 to about 28 carbon atoms. In one embodiment, the normal alpha-olefins or mixtures of normal alpha-olefins have from about 18 to about 24 carbon atoms.

In one embodiment, suitable alkyl phenolic compounds comprise distilled cashew nut shell liquid or hydrogenated distilled cashew nut shell liquid. Distilled CNSL is a mixture of biodegradable meta-hydrocarbyl substituted phenols, where the hydrocarbyl group is linear and unsaturated, including cardanol. Catalytic hydrogenation of distilled CNSL gives rise to a mixture of meta-hydrocarbyl substituted phenols predominantly rich in 3-pentadecylphenol.

The alkylphenols can be para-alkylphenols, meta-alkylphenols or ortho alkylphenols. Since it is believed that p-alkylphenols and m-alkylphenols facilitate the preparation of highly overbased alkylphenate detergents where overbased products are desired, the alkylphenol is preferably predominantly a para alkylphenol or meta alkylphenol with no more than about 45 mole percent of the alkylphenol being ortho alkylphenols; and more preferably no more than about 35 mole percent of the alkylphenol is ortho alkylphenol. Alkyl-hydroxy toluenes or xylenes, and other alkyl phenols having one or more alkyl substituents in addition to at least one long chained alkyl substituent can also be used. In the case of distilled cashew nut shell liquid, the catalytic hydrogenation of distilled CNSL gives rise to a mixture of meta-hydrocarbyl substituted phenols.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkali or alkaline earth metal salt of an alkyl-substituted hydroxyaromatic carboxylic acid, which is known in the art as a "carboxylate" or a "salicylate, is derived from an alpha olefin having from about 10 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole % (e.g., at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkaline earth metal salt of an alkyl-substituted hydroxybenzoic acid detergent are a Czo or higher. In another embodiment, the alkali or alkaline earth metal salt of an alkyl-substituted hydroxyaromatic carboxylic acid is an alkali or alkaline earth metal salt of an alkyl-substituted hydroxybenzoic acid that is derived from an alkyl-substituted hydroxybenzoic acid in which the alkyl groups are the residue of normal alpha-olefins containing at least 75 mole % Czo or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkali or alkaline earth metal salt of an alkyl-substituted hydroxybenzoic acid are about $C_{14}$ to about $C_{18}$.

The resulting alkali or alkaline earth metal salt of an alkyl-substituted hydroxyaromatic carboxylic acid will be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

The alkali or alkaline earth metal salts of an alkyl-substituted hydroxyaromatic carboxylic acid can be neutral or overbased. Generally, an overbased alkali or alkaline earth metal salt of an alkyl-substituted hydroxyaromatic carboxylic acid is one in which the TBN of the alkali or alkaline earth metal salts of an alkyl-substituted hydroxyaromatic carboxylic acid has been increased by a process such as the addition of a base source (e.g., lime) and an acidic overbasing compound (e.g., carbon dioxide).

Overbased alkaline earth metal phenol-based or alkylphenate detergents may be low overbased (LOB), e.g., an overbased salt having a TBN below 100. In one embodiment, the TBN of a low overbased salt may be from about 5 to about 50. In another embodiment, the TBN of a low overbased salt may be from about 10 to about 30. In yet another embodiment, the TBN of a low overbased salt may be from about 15 to about 20.

Overbased alkaline earth metal phenol-based or alkylphenate detergents may be medium overbased (MOB), e.g., an overbased salt having a TBN from about 100 to about 250. In one embodiment, the TBN of a medium overbased salt may be from about 100 to about 200. In another embodiment, the TBN of a medium overbased salt may be from about 125 to about 175.

Overbased alkaline earth metal phenol-based or alkylphenate detergents may be high overbased (HOB), e.g., an overbased salt having a TBN above 250. In one embodiment, the TBN of a high overbased salt may be from about 250 to about 550.

Generally, the amount of alkaline earth metal phenol-based or alkylphenate detergent can be from about 0.001 wt. % to about 50 wt. %, or from about 0.05 wt. % to about 45 wt. %, or from about 0.05 to about 40.0 wt. %, or from about 0.05 wt. % to about 35.0 wt. %, or from about 0.05 wt. % to about 30.0 wt. %, or from about 0.05 wt. % to about 25 wt. %, or from about 0.1 wt. % to about 20 wt. %, or from about 0.01 to 15 wt. %, or from about 0.01 to 10 wt. %, or from about 0.01 to about 5.0 wt. % based on the total weight of the marine diesel lubricating oil composition.

Sulfonate detergents may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. In one embodiment, the alkyl substituent of the alkyl substituted aromatic hydrocarbon is at least one normal alpha olefin having from about 10 to about 40 carbon atoms. In one embodiment, the normal alpha-olefins or mixtures of normal alpha-olefins have from about 16 to about 30 carbon atoms. In one embodiment, the normal alpha-olefins or mixtures of normal alpha-olefins have from about 18 to about 30 carbon atoms. In one embodiment, the normal alpha-olefins or mixtures of normal alpha-olefins have from about 20 to about 28 carbon atoms. In one embodiment, the normal alpha-olefins have from about 18 to about 24 carbon atoms. In one embodiment, the alkyl substituent of the alkyl substituted aromatic hydrocarbon is a residue of at least one isomerized olefin having from about 15 to about 99 wt. % branching obtained by isomerizing at least one normal alpha olefin The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to about 220 wt. % (preferably at least about 125 wt. %) of that stoichiometrically required.

Overbased sulfonate detergents may be low overbased, e.g., an overbased salt having a TBN below 100. In one embodiment, the TBN of a low overbased salt may be from about 5 to about 50. In another embodiment, the TBN of a low overbased salt may be from about 10 to about 30. In yet another embodiment, the TBN of a low overbased salt may be from about 15 to about 20.

Overbased sulfonate detergents may be medium overbased, e.g., an overbased salt having a TBN from about 100 to about 250. In one embodiment, the TBN of a medium overbased salt may be from about 100 to about 200. In another embodiment, the TBN of a medium overbased salt may be from about 125 to about 175.

Overbased sulfonate detergents may be high overbased, e.g., an overbased salt having a TBN above 250. In one embodiment, the TBN of a high overbased salt may be from about 250 to about 700.

Generally, the amount of sulfonate detergent can be from about 0.001 wt. % to about 50 wt. %, or from about 0.05 wt. % to about 45 wt. %, or from about 0.05 wt. % to about 40 wt. %, or from about 0.05 wt. % to about 30 wt. %, or from about 0.05 wt. % to about 25 wt. %, or from about 0.1 wt. % to about 20 wt. %, or from about 0.01 to 15 wt. %, or from about 20 to 50 wt. %, or from about 30 to 50 wt. %, based on the total weight of the marine diesel lubricating oil composition.

In one embodiment, the marine diesel cylinder lubricating oil composition of the present invention further includes one or more polyalkenyl bis-succinimide dispersants wherein the polyalkenyl substituent is derived from a polyalkene group having a number average molecular weight of from about 900 to about 3000. In general, a bis-succinimide is the completed reaction product from the reaction between a polyalkenyl-substituted succinic acid or anhydride and one or more polyamine reactants, and is intended to encompass compounds wherein the product may have amide, amidine, and/or salt linkages in addition to the imide linkage of the type that results from the reaction of a primary amino group and anhydride moiety. The bis-succinimide dispersants is prepared according to methods that are well known in the art, e.g., certain fundamental types of succinimides and related materials encompassed by the term of art "succinimide" are taught in, for example, U.S. Pat. Nos. 2,992,708; 3,018,291; 3,024,237; 3,100,673; 3,219,666; 3,172,892; and 3,272,746, the content of which are hereby incorporated by reference.

In one embodiment the one or more polyalkenyl bis-succinimide dispersants can be obtained by reacting a polyalkenyl-substituted succinic anhydride of formula I:

(I)

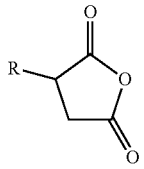

wherein R is a polyalkenyl substituent is derived from a polyalkene group having a number average molecular weight of from about 900 to about 3000 with a polyamine. In one embodiment, R is a polyalkenyl substituent is derived from a polyalkene group having a number average molecular weight of from about 900 to about 2500. In one embodiment, R is a polybutenyl substituent derived from a polybutene having a number average molecular weight of from about 1500 to about 3000. In another embodiment, R is a polybutenyl substituent derived from a polybutenes having a number average molecular weight of from about 2000 to about 3000. In another embodiment, R is a polybutenyl substituent derived from a polybutene having a number average molecular weight of from about 1500 to about 2500.

The preparation of the polyalkenyl-substituted succinic anhydride by reaction with a polyolefin and maleic anhydride has been described in, e.g., U.S. Pat. Nos. 3,018,250 and 3,024,195. Such methods include the thermal reaction of the polyolefin with maleic anhydride and the reaction of a halogenated polyolefin, such as a chlorinated polyolefin, with maleic anhydride. Reduction of the polyalkenyl-substituted succinic anhydride yields the corresponding alkyl derivative. Alternatively, the polyalkenyl substituted succinic anhydride may be prepared as described in, e.g., U.S. Pat. Nos. 4,388,471 and 4,450,281, the contents of which are incorporated by reference herein.

Polyalkene groups having a number average molecular weight of from about 900 to about 3000 for reaction with a succinic anhydride such as maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of 2 or more such olefins such as copolymers of: ethylene and propylene, butylene, and isobutylene, etc. Other copolymers include those in which a minor amount of the copolymer monomers, e.g., 1 to 20 mole percent is a $C_4$ to $C_8$ nonconjugated diolefin, e.g., a copolymer of isobutylene and butadiene or a copolymer of ethylene, propylene and 1,4-hexadiene, etc.

A particularly preferred class of polyalkene groups having a number average molecular weight of from about 900 to about 3000 include polybutenes, which are prepared by polymerization of one or more of 1-butene, 2-butene and isobutene. Especially desirable are polybutenes containing a substantial proportion of units derived from isobutene. The polybutene may contain minor amounts of butadiene which may or may not be incorporated in the polymer. Most often the isobutene units constitute about 80%, or at least about 90%, of the units in the polymer. These polybutenes are readily available commercial materials well known to those skilled in the art, e.g., those described in, for example, U.S. Pat. Nos. 3,215,707; 3,231,587; 3,515,669; 3,579,450, and 3,912,764, the contents of which are incorporated by reference herein.

Suitable polyamines for use in preparing the non-borated bis-succinimide dispersants include polyalkylene polyamines. Such polyalkylene polyamines will typically contain about 2 to about 12 nitrogen atoms and about 2 to 24 carbon atoms. Particularly suitable polyalkylene polyamines are those having the formula: $H_2N—(R^1NH)_c—H$ wherein $R^1$ is a straight- or branched-chain alkylene group having 2 or 3 carbon atoms and c is 1 to 9. Representative examples of suitable polyalkylene polyamines include ethylenediamine, diethylenetriamine, triethylenetetraamine, tetraethylenepentamine and mixtures thereof. Most preferably, the polyalkylene polyamine is tetraethylenepentamine.

Examples of suitable polyamines include tetraethylene pentamine, pentaethylene hexamine, and heavypolyamines (e.g. Dow HPA-X number average molecular weight of 275, available from Dow Chemical Company, Midland, Mich.). Such amines encompass isomers, such as branched-chain polyamines, and the previously mentioned substituted polyamines, including hydrocarbyl-substituted polyamines. HPA-X heavy polyamine ("HPA-X") contains an average of approximately 6.5 amine nitrogen atoms per molecule. Such heavy polyamines generally afford excellent results.

Generally, the concentration of the one or more polyalkenyl bis-succinimide dispersants wherein the polyalkenyl substituent is derived from a polyalkene group having a number average molecular weight of from about 900 to about 3000 in a marine diesel cylinder lubricating oil composition of the present invention is greater than about 0.25 wt. %, or greater than about 0.5 wt. %, or greater than about 1.0 wt. %, or greater than about 1.2 wt. %, or greater than about 1.5 wt. %, or greater than about 1.8 wt. %, or greater than about 2.0 wt. %, or greater than about 2.5 wt. %, or greater than about 2.8 wt. %, on an active basis, based on the total weight of the marine diesel lubricating oil composition. In another embodiment, the amount of the one or more non-borated polyalkenyl bis-succinimide dispersants wherein the polyalkenyl substituent is derived from a polyalkene group having a number average molecular weight of from about 900 to about 3000 present in a marine diesel lubricating oil composition of the present invention can range from about 0.25 to 10 wt. %, or about 0.25 to 8.0 wt. %, or about 0.25 to 5.0 wt. %, or about 0.25 to 4.0 wt. %, or 0.25 to 3.0 wt. %, or about 0.5 to 10 wt. %, or about 0.5 to 8.0 wt. %, or about 0.5 to 5.0 wt. %, or about 0.5 to 4.0 wt. %, or about 0.5 to 3.0 wt. %, or about 0.5 to 10 wt. %, or about 0.5 to 8.0 wt. %, or about 1.0 to 5.0 wt. %, or about 1.0 to 4.0 wt. %, or about 1.0 to 3.0 wt. %, or about 1.5 to 10 wt. %, or about 1.5 to 8.0 wt. %, or about 1.5 to 5.0 wt. %, or about 1.5 to 4.0 wt. %, or about 1.5 to 3.0 wt. %, or about 2.0 to 10 wt. %, or about 2.0 to 8.0 wt. %, or about 2.0 to 5.0 wt. % or about 2.0 to 4.0 wt. % on an active basis, based on the total weight of the marine diesel cylinder lubricating oil composition.

In another embodiment, the marine diesel cylinder lubricating oil composition of the present invention further includes a cyclic carbonate post-treated polyalkenyl bis-succinimide dispersant. The polyalkenyl bis-succinimide dispersant of this embodiment can be prepared as described above, i.e., the reaction of a polyalkenyl-substituted succinic anhydride with a poly amine.

The polyalkenyl bis-succinimide dispersants of this embodiment is post-treated with a cyclic carbonate to form a cyclic carbonate post-treated polyalkenyl bis-succinimide dispersants. Suitable cyclic carbonates for use in this invention include, but are not limited to, 1,3-dioxolan-2-one (ethylene carbonate): 4-methyl-1,3-dioxolan-2-one (propylene carbonate); 4-hydroxymethyl-1,3-dioxolan-2-one: 4,5-dimethyl-1,3-dioxolan-2-one; 4-ethyl-1,3-dioxolan-2-one (butylene carbonate) and the like. Other suitable cyclic carbonates may be prepared from saccharides, such as sorbitol, glucose, fructose, galactose and the like and from vicinal diols prepared from $C_1$ to $C_{30}$ olefins by methods known in the art.

The polyalkenyl bis-succinimide dispersant can be post-treated with the cyclic carbonate according to methods well known in the art. For example, a cyclic carbonate post-treated polyalkenyl bis-succinimide dispersant can be prepared by a process comprising charging the bis-succinimide dispersant in a reactor, optionally under a nitrogen purge, and heating at a temperature of from about 80° C. to about 170° C. Optionally, diluent oil may be charged under a nitrogen purge in the same reactor. A cyclic carbonate is charged, optionally under a nitrogen purge, to the reactor. This mixture is heated under a nitrogen purge to a temperature in range from about 130° C. to about 200° C. Optionally, a vacuum is applied to the mixture for about 0.5 to about 2.0 hours to remove any water formed in the reaction.

In one embodiment, the marine diesel lubricating oil compositions of the present invention contain essentially no thickener (i.e., a viscosity index improver).

The marine diesel lubricating oil composition of the present invention can contain one or more antioxidants that can reduce or prevent the oxidation of the base oil. Non-limiting examples of suitable antioxidants include amine-based antioxidants (e.g., alkyl diphenylamines such as bis-nonylated diphenylamine, bis-octylated diphenylamine, and octylated/butylated diphenylamine, phenyl-α-naphthylamine, alkyl or arylalkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol and the like), phosphorous-based antioxidants, zinc dithiophosphate, and combinations thereof.

The amount of the antioxidant may vary from about 0.01 wt. % to about 10 wt. %, from about 0.05 wt. % to about 5 wt. %, or from about 0.1 wt. % to about 3 wt. %, based on the total weight of the marine diesel lubricating oil composition.

The marine diesel lubricating oil composition of the present invention can contain one or more friction modifiers that can lower the friction between moving parts. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof.

The marine diesel lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphorus content. In some embodiments, the phosphorus content of the lubricating oil composition disclosed herein is from about 0.01 wt. % to about 0.14 wt., based on the total weight of the lubricating oil composition.

The marine diesel lubricating oil composition of the present invention can contain one or more foam inhibitors or anti-foam inhibitors that can break up foams in oils. Non-limiting examples of suitable foam inhibitors or anti-foam inhibitors include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof.

The marine diesel lubricating oil composition of the present invention can contain one or more pour point depressants that can lower the pour point of the marine diesel lubricating oil composition. Any pour point depressant known by a person of ordinary skill in the art may be used in the marine diesel lubricating oil composition. Non-limiting examples of suitable pour point depressants include polymethacrylates, alkyl acrylate polymers, alkyl methacrylate polymers, di(tetra-paraffin phenol)phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like.

In another embodiment, the marine diesel lubricating oil composition of the present invention can contain one or more demulsifiers that can promote oil-water separation in lubricating oil compositions that are exposed to water or steam. Any demulsifier known by a person of ordinary skill in the art may be used in the marine diesel lubricating oil composition. Non-limiting examples of suitable demulsifiers include anionic surfactants (e.g., alkyl-naphthalene sulfonates, alkyl benzene sulfonates and the like), nonionic alkoxylated alkyl phenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof.

The marine diesel lubricating oil composition of the present invention can contain one or more corrosion inhibitors that can reduce corrosion. Any corrosion inhibitor known by a person of ordinary skill in the art may be used in the marine diesel lubricating oil composition. Non-limiting examples of suitable corrosion inhibitor include half esters or amides of dodecylsuccinic acid, phosphate esters, thiophosphates, alkyl imidazolines, sarcosines and combinations thereof.

The marine diesel lubricating oil composition of the present invention can contain one or more extreme pressure (EP) agents that can prevent sliding metal surfaces from seizing under conditions of extreme pressure. Any extreme pressure agent known by a person of ordinary skill in the art may be used in the marine diesel lubricating oil composition. Generally, the extreme pressure agent is a compound that can combine chemically with a metal to form a surface film that prevents the welding of asperities in opposing metal surfaces under high loads.

Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof.

The marine diesel lubricating oil composition of the present invention can contain one or more rust inhibitors that can inhibit the corrosion of ferrous metal surfaces. Non-limiting examples of suitable rust inhibitors include non-ionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof; synthetic alkarylsulfonates, e.g., metal dinonylnaphthalene sulfonates; and the like and mixtures thereof.

The marine diesel cylinder lubricating oil compositions of the present invention may also contain additional additives for imparting auxiliary functions. For example, the marine diesel lubricating oil compositions can be blended with antioxidants, detergents, anti-wear agents, rust inhibitors, dehazing agents, demulsifying agents, metal deactivating agents, friction modifiers, pour point depressants, antifoaming agents, co-solvents, corrosion-inhibitors, extreme pressure agents and the like and mixtures thereof. A variety of the additives are known and commercially available. These additives can be employed for the preparation of the marine diesel lubricating oil compositions of the invention by the usual blending procedures.

The marine diesel cylinder lubricating oil compositions of the present invention may contain dyes or marker components which are particularly suitable for marking lubricants to protect brand equity, prevent misidentification and aid in identifying leaks.

The most useful types of markers or dyes are ones which may be extracted easily from said marked liquids, measured and/or identified. The many additives and tracers which have been proposed for use or are in current use for marking or tagging lubricants include color and fluorescent dyes (e.g., diazo dyes, anthraquinone dyes, phthalein dyes, and the like), radioactive substances, metal compounds or complexes (e.g., metal organic compounds, metal salts, metal oxides, metal coordination complexes and the like), and a variety of specific compounds which react in combination with selected agents to provide intensely colored derivatives.

Markers may be used alone or in combination with one another. Where multiple markers are used, the mixture may still be referred to as a marker substance, in the singular. In one embodiment the marker substance is stable to, and survives, the operational conditions of the lubricant.

Dyes are commercially available in solid or liquid form. Some are soluble in polar solvents (water, alcohol, ketones), while others will dissolve in hydrocarbons. Dyes in liquid form usually contain a solvent and are much easier to dissolve in lubricating oils than solid dyes. A dye should be intense enough so that the desired level of coloration can be attained with a low concentration of added dye. Rohm and Haas Automate® dyes are supplied in a high-flash hydrocarbon solvent and dissolve readily in petroleum based lubricating oils. Some of the colors available are Automate Blue 8AHF, Automate Green HFXS, AutomateYellow HF, Automate Brown 2HFXS, and Automate Orange 2HFXS. Most dyes will produce visible color at 100 to 250 ppm by volume.

An alternative to colored dyes is fluorescent dyes. Fluorescent dyes show no color under normal light but fluoresce under ultraviolet radiation. Fluorescent dyes are used at very low concentrations in a variety of fluids.

Some examples of specific compounds which have been employed in lubricants for marking purposes, include quinizarin, furfural, diphenylamine, and various naphthol derivatives. In another embodiment of the present invention, the marker compound comprises 4-dimethylaminoazobenzene, 4-diethylaminoazo-benzene, p-dimethylaminoazobenzene-o-carboxylic acid, 2-aminoazo-toluene; thymol blue; thymolphthalein; malachite green carbinol base or mixtures thereof.

Examples of markers having at least one radiopaque portion including a radiopaque material include material selected from the group consisting of: barium sulfate, bismuth trioxide, iodine, iodide, titanium oxide, zirconium oxide, gold, platinum, silver, tantalum, niobium, stainless steel, and combinations thereof. Materials such as certain metallic soaps, metallic soaps of fatty acids, metallic carboxylates, or known metal drying agents supplied as solutions containing metals such as cobalt, lead, magnesium, titanium, zirconium, manganese, rhodium, platinum, aluminum, manganese, calcium, cerium, copper, nickel, vanadium, barium, tungsten, vanadium, and zinc, and mixtures thereof are also useful as lubricant markers. Examples of zirconium containing materials can include zirconium carboxylates such as zirconium 2-ethylhexanoate, zirconium octoate and zirconium salicylate materials.

The amount of marker present in the lubricant is not overly limited as long as there is enough marker to effectively trace the marker or react with a reagent, and there is not so much marker that it interferes or enhances the performance of the lubricant. Non-metal containing markers may be present in the lubricant at concentrations of 10 to 10,000 ppm or 10 to 1,000 ppm. Markers containing metals may be present in the lubricant at a concentration of about 5 to 150 ppm of metal in the lubricating oil composition.

Without limiting the scope of the disclosure, the following is an item list of embodiments:

Item 1. A marine diesel cylinder lubricating oil composition comprising:

(a) a major amount of an oil of lubricating viscosity; and (b) a minor amount of a phenol-based detergent;

wherein the marine diesel cylinder lubricating oil composition has a BN of greater than 140 mg KOH/g, and further wherein the marine diesel cylinder lubricating oil composition is substantially free of unsulfurized tetrapropenyl phenol and its unsulfurized metal salt.

Item 2. The marine diesel cylinder lubricating oil composition according to item 1, wherein the phenol-based detergent is a carboxylate, a salicylate, an alkylphenate, a sulfurized alklylphenate, or any combination thereof.

Item 3. The marine diesel cylinder lubricating oil composition according to item 1 or 2 (or item 1), wherein the phenol-based detergent is a metal salt.

Item 4. The marine diesel cylinder lubricating oil composition according to item 3, wherein the metal salt is an alkaline metal salt or alkaline earth metal salt.

Item 5. The marine diesel cylinder lubricating oil composition according to items 1 through 4 (or item 1), further comprising (c) a minor amount of an additional detergent different from the phenol-based detergent of (b).

Item 6. The marine diesel cylinder lubricating oil composition according to items 1 through 5 (or item 1), wherein the BN of the marine lubricating oil composition ranges from 145 to 210, from 150 to 210, from 155 to 210, from 160 to 210, or from 170 to 210, from 180 to 210, from 145 to 200, from 150 to 200, from 160 to 200, or from 180 to 200 mg KOH/g.

Item 7. A marine diesel cylinder lubricating oil composition comprising:

(a) a major amount of an oil of lubricating viscosity; and (b) a minor amount of an overbased alkaline earth metal alkylphenate detergent;

wherein the marine diesel cylinder lubricating oil composition has a BN of greater than 140 mg KOH/g, and further wherein the marine diesel cylinder lubricating oil composition is substantially free of unsulfurized tetrapropenyl phenol and its unsulfurized metal salt.

Item 8. The marine diesel cylinder lubricating oil composition according to item 7, further comprising (c) a minor amount of an additional detergent different from the overbased alkaline earth metal alkylphenate detergent of (b).

Item 9. The marine diesel cylinder lubricating oil composition according to item 7 or 8 (or item 7), wherein the BN of the marine lubricating oil composition ranges from 145 to 210, from 150 to 210, from 155 to 210, from 160 to 210, or from 170 to 210, from 180 to 210, from 145 to 200, from 150 to 200, from 160 to 200, or from 180 to 200 mg KOH/g.

The following non-limiting examples are illustrative of the present invention.

The concentration of total free unsulfurized alkylhydroxyaromatic compound and its unsulfurized metal salts (i.e., "TPP" or "total residual TPP" or "total TPP") in the detergents listed below was determined by reverse phase High Performance Liquid Chromatography (HPLC). In the HPLC method, samples were prepared for analysis by weighing accurately 80 to 120 mg of sample into a 10 ml volumetric flask, diluting to the level mark with methylene chloride, and mixing until the sample is fully dissolved.

The HPLC system used in the HPLC method included a HPLC pump, a thermostatted HPLC column compartment, HPLC fluorescence detector, and PC-based chromatography data acquisition system. The particular system described is based on an Agilent 1200 HPLC with ChemStation software. The HPLC column was a Phenomenex Luna C8(2) 150×4.6 mm 5 μm 100 Å, P/N 00F4249E0.

The following system settings were used in performing the analyses:

Pump flow=1.0 ml/min

Maximum pressure=200 bars

Fluorescence wavelength: 225 excitation 313 emission: Gain=9

Column Thermostat temperature=25 C

Injection Size=1 μL of diluted sample

Elution type: Gradient, reverse phase

Gradient: 0-7 min 85/15 methanol/water switching to 100% methanol linear gradient.

Run time: 17 minutes

The resulting chromatogram typically contains several peaks. Peaks due to the free unsulfurized TPP typically elute together at early retention times; whereas peaks due to sulfurized salts of alkylhydroxyaromatic compounds typically elute at longer retention times. For purposes of quantitation, the area of the single largest peak of the free unsulfurized TPP and its unsulfurized metal salt was measured, and then that area was used to determine the concentration of the total free unsulfurized TPP and its unsulfurized metal salt species. The assumption is that the speciation of alkylhydroxyaromatic compounds does not change; if something does change the speciation of the alkylhydroxyaromatic compounds, then recalibration is necessary.

The area of the chosen peak is compared to a calibration curve to arrive at the wt. % of free alkylphenol and free unsulfurized salts of alkylphenols. The calibration curve was developed using the same peak in the chromatogram obtained for the free unsulfurized TPP used to make the phenate product.

DSC Oxidation Test

The DSC test is used to evaluate thin film oxidation stability of test oils, in accordance with ASTM D-6186. Heat flow to and from test oil in a sample cup is compared to a reference cup during the test. The Oxidation Onset Temperature is the temperature at which the oxidation of the test oil starts. The Oxidation Induction Time is the time at which the oxidation of the test oil starts. A higher oxidation induction time means better performance. The oxidation reaction results in an exothermic reaction which is clearly shown by the heat flow. The Oxidation Induction Time is calculated to evaluate the thin film oxidation stability of the test oil.

Examples 1-5, and Comparative Example A

The 190 BN, SAE 50 viscosity grade, fully formulated marine cylinder lubricating oil compositions of Examples 1-5 and Comparative Example A were prepared and evaluated using the Differential Scanning calorimeter (DSC) test which is used to evaluate thin film oxidation stability of test oils. In addition to the detergents indicated below in Table 1, all test oils contained foam inhibitor, 0.2 wt. % succinimide dispersant and API Group I baseoil. Example 5 additionally contained 2.0 wt. % of an alkarylpolyether. The results of the DSC Oxidation Test for the MCL compositions are set forth in the table below.

TABLE 1

| | Example 1 | Example 2 | Example 3 | Example 4 | Example 5 | Comp Ex A |
|---|---|---|---|---|---|---|
| HOB Sulfonate, wt % | 43.5 | 43.3 | 43.3 | — | 44.14 | 44.52 |
| LOB Sulfonate, wt % | — | 4.0 | — | — | — | 4.0 |
| HOB Phenate[1], wt % | 1.5 | 1.5 | — | — | — | — |
| MOB Phenate[2], wt % | 1.0 | 1.0 | — | — | 2.0 | — |
| HOB Carboxylate[3], wt % | — | — | — | 52.5 | — | — |
| MOB Carboxylate[4], wt % | — | — | 4.0 | 4.0 | — | — |
| TBN mgKOH/g | 190 | 190 | 190 | 190 | 190 | 190 |
| Vis (100° C.), cSt | 19.2 | 19.6 | 19.7 | 19.9 | 19.6 | 19.5 |
| TPP, wt. % | 0.12 | 0.12 | 0.0 | 0.0 | 0.07 | 0.0 |
| DSC, min | 12.81 | 13.37 | 12.19 | 29.13 | 15.16 | 5.37 |

[1]An overbased calcium sulfurized alkylphenate having an alkyl substituent derived from propylene tetramer (9.6 wt. % Ca, 31.0 wt. % diluent oil, TBN of 260)

[2]An overbased calcium sulfurized alkylphenate having an alkyl substituent derived from propylene tetramer (4.25 wt. % Ca, 42.0 wt. % diluent oil, TBN of 116)

[3]An overbased calcium alkylhydroxybenzoate, having an alkyl substituent derived from $C_{20}$ to $C_{28}$ linear normal alpha olefins (12.5 wt. % Ca, 33.0 wt. % diluent oil, TBN of 350)

[4]An overbased calcium alkylhydroxybenzoate, having an alkyl substituent derived from $C_{20}$ to $C_{28}$ linear normal alpha olefins (5.35 wt. % Ca, 35.0 wt. % diluent oil, TBN of 150)

As is evident from the results illustrated in Table 1, the marine cylinder lubricating oil compositions of Examples 1-5 containing a phenol-based detergent, being substantially free of TPP, exhibited surprisingly better oxidative stability properties at elevated temperatures, as is evident by their overall higher ratings, over the comparative example which did not contain phenol-based detergent.

What is claimed is:

1. A marine diesel cylinder lubricating oil composition comprising:

(a) a major amount of an oil of lubricating viscosity; and (b) a minor amount of a phenol-based detergent, wherein the minor amount of the phenol-based detergent includes (i) a high overbased phenate detergent having a TBN above 250 or a high overbased carboxylate detergent having a TBN above 250 and (ii) a medium overbased phenate detergent having a TBN of about 100 to about 250 or medium overbased carboxylate detergent having a TBN of about 100 to about 250; and wherein the marine diesel cylinder lubricating oil composition has a BN of greater than 140 mg KOH/g, and further wherein the marine diesel cylinder lubricating oil composition is substantially free of unsulfurized tetrapropenyl phenol and its unsulfurized metal salt.

2. The marine diesel cylinder lubricating oil composition according to claim 1, wherein the phenol-based detergent is a metal salt.

3. The marine diesel cylinder lubricating oil composition according to claim 2, wherein the metal salt is an alkaline metal salt or alkaline earth metal salt.

4. The marine diesel cylinder lubricating oil composition according to claim 1, further comprising: (c) a minor amount of an additional detergent different from the phenol-based detergent of (b).

5. The marine diesel cylinder lubricating oil composition according to claim 1, wherein the BN of the marine lubricating oil composition ranges from 145 to 210 mg KOH/g.

6. A marine diesel cylinder lubricating oil composition comprising:

(a) a major amount of an oil of lubricating viscosity; and (b) a minor amount of an overbased alkaline earth metal alkylphenate detergent, wherein the minor amount of the overbased alkaline earth metal alkylphenate detergent includes (i) a high overbased alkaline earth metal alkylphenate detergent having a TBN above 250 and (ii) a medium overbased alkaline earth metal alkylphenate detergent having a TBN of about 100 to about 250; and wherein the marine diesel cylinder lubricating oil composition has a BN of greater than 140 mg KOH/g, and further wherein the marine diesel cylinder lubricating oil composition is substantially free of unsulfurized tetrapropenyl phenol and its unsulfurized metal salt.

7. The marine diesel cylinder lubricating oil composition according to claim 6, further comprising (c) a minor amount of an additional detergent different from the overbased alkaline earth metal alkylphenate detergent of (b).

8. The marine diesel cylinder lubricating oil composition according to claim 6, wherein the BN of the marine lubricating oil composition ranges from 145 to 210 mg KOH/g.

9. The marine diesel cylinder lubricating oil composition according to claim 1, wherein the marine diesel cylinder lubricating oil composition has from about 0.0001 wt % to about 0.3 wt % unsulfurized tetrapropenyl phenol and its unsulfurized metal salt.

10. The marine diesel cylinder lubricating oil composition according to claim 6, wherein the marine diesel cylinder lubricating oil composition has from about 0.0001 wt % to about 0.3 wt % unsulfurized tetrapropenyl phenol and its unsulfurized metal salt.

11. The marine diesel cylinder lubricating oil composition according to claim 1, wherein the phenol-based detergent is an alkylphenate detergent present in an amount from about 0.01 to 10 wt % based on the total weight of the marine diesel lubricating oil composition.

12. The marine diesel cylinder lubricating oil composition according to claim 6, wherein the overbased alkaline earth metal alkylphenate detergent is present in an amount from about 0.01 to 10 wt % based on the total weight of the marine diesel lubricating oil composition.

13. The marine diesel cylinder lubricating oil composition according to claim 4, wherein the minor amount of the additional detergent different from the phenol-based detergent of (b) is a sulfonate detergent present in an amount from about 30 to 50 wt % based on the total weight of the marine diesel cylinder lubricating oil composition.

14. A marine diesel cylinder lubricating oil composition comprising:

(a) a major amount of an oil of lubricating viscosity; and (b) a minor amount of a phenol-based detergent, wherein the minor amount of the phenol-based detergent includes (i) a high overbased phenate detergent having a TBN above 250 or a high overbased carboxylate detergent having a TBN above 250 and (ii) a medium overbased phenate detergent having a TBN of about 100 to about 250 or medium overbased carboxylate detergent having a TBN of about 100 to about 250; and wherein the marine diesel cylinder lubricating oil composition has a BN of greater than 140 mg KOH/g, the marine diesel cylinder lubricating oil composition is substantially free of unsulfurized tetrapropenyl phenol and its unsulfurized metal salt, and the marine diesel cylinder lubricating oil composition has a better oxidative stability at elevated temperatures than if the marine diesel cylinder lubricating oil composition had the same BN and detergents not including a phenol-based detergent.

15. The marine diesel cylinder lubricating oil composition according to claim 14, further comprising (c) a high overbased sulfonate detergent having a TBN above 250.

16. The marine diesel cylinder lubricating oil composition according to claim 15, further comprising (d) a low overbased sulfonate detergent having a TBN below 100.

* * * * *